US005701606A

United States Patent [19]

Aldridge

[11] Patent Number: 5,701,606

[45] Date of Patent: Dec. 30, 1997

[54] FIREFIGHTER GARMENT WITH CLOSED-CELL FOAM LINER

[75] Inventor: Donald Aldridge, New Carlisle, Ohio

[73] Assignee: Lion Apparel, Inc., Dayton, Ohio

[21] Appl. No.: 119,473

[22] Filed: Sep. 10, 1993

[51] Int. Cl.[6] ..... A41D 13/00

[52] U.S. Cl. ..... 2/81; 2/86; 2/97; 2/458

[58] Field of Search ..... 2/2, 81, 82, 86, 2/87, 97, 2.15, 2.16, 22, 23, 24, 69, 70, 79, 85, 93, 108, 227; 428/920

[56] References Cited

U.S. PATENT DOCUMENTS

| | | | |
|---|---|---|---|
| 2,570,182 | 10/1951 | Daly et al. | 260/2.5 |
| 2,976,539 | 3/1961 | Brown, Jr. | 2/2 |
| 2,981,954 | 5/1961 | Garbellano | 2/82 |
| 4,034,417 | 7/1977 | Ellis | 2/81 |
| 4,502,153 | 3/1985 | Lapedes et al. | 2/81 |
| 4,583,247 | 4/1986 | Fingerhut et al. | 2/81 |
| 4,604,759 | 8/1986 | Bowman et al. | 2/81 |
| 4,685,155 | 8/1987 | Fingerhut et al. | 2/272 |
| 4,805,244 | 2/1989 | Scott | 2/81 |
| 4,843,646 | 7/1989 | Grilliot et al. | 2/69 |
| 4,860,382 | 8/1989 | Markwell | 2/82 |
| 4,864,655 | 9/1989 | McKenney et al. | 2/81 |
| 4,922,552 | 5/1990 | Grilliot et al. | 2/93 |
| 4,994,317 | 2/1991 | Dugan et al. | 428/246 |
| 5,001,781 | 3/1991 | Grilliot et al. | 2/81 |
| 5,021,280 | 6/1991 | Farnworth et al. | 428/920 |
| 5,044,031 | 9/1991 | Sherwood et al. | 2/69 |
| 5,054,125 | 10/1991 | Snedeker | 2/81 |
| 5,095,549 | 3/1992 | Aldridge | 2/81 |
| 5,136,723 | 8/1992 | Aldridge et al. | 2/81 |
| 5,150,476 | 9/1992 | Statham et al. | 2/81 |
| 5,274,846 | 1/1994 | Kolsky | 2/2 |

OTHER PUBLICATIONS

Ocean Class catalog, Mustang Industries Inc.
Product Information—Mustange Aviation Coveral Model Series—MAC, Jul., 1993, Mustang Industries Inc.
Mustang Manufacturing Inc. Aviation Coverall.
Patagonia, Inc. Impact Tights.
Mustang Industries Marine Wear Brochure, 1986.
Product Information, Mustang Aviation Coverall, 1983.

*Primary Examiner*—Diana Biefeld
*Attorney, Agent, or Firm*—Thompson Hine & Flory LLP

[57] ABSTRACT

A firefighter garment having an outer shell and an inner liner functioning as a combined thermal barrier and moisture barrier made of a fire-retardant, closed-cell foam material. The closed-cell foam liner is moisture resistant and at the same time provides adequate thermal insulation. The moisture resistance of the foam liner eliminates the need for a separate moisture barrier, and, in one embodiment, allows the liner to be bonded directly to the outer shell. However, in a preferred embodiment, the inner liner is separate from the shell and includes a fabric substrate of an aramid fiber to which it is bonded. The fabric substrate faces the wearer and prevents abrasion of the foam by the wearer and enhances the tear strength of the foam. Such closed-cell foam material may be used either as a continuous thermal barrier extending throughout the garment and/or in selected areas which require additional padding or thermal resistance.

17 Claims, 2 Drawing Sheets

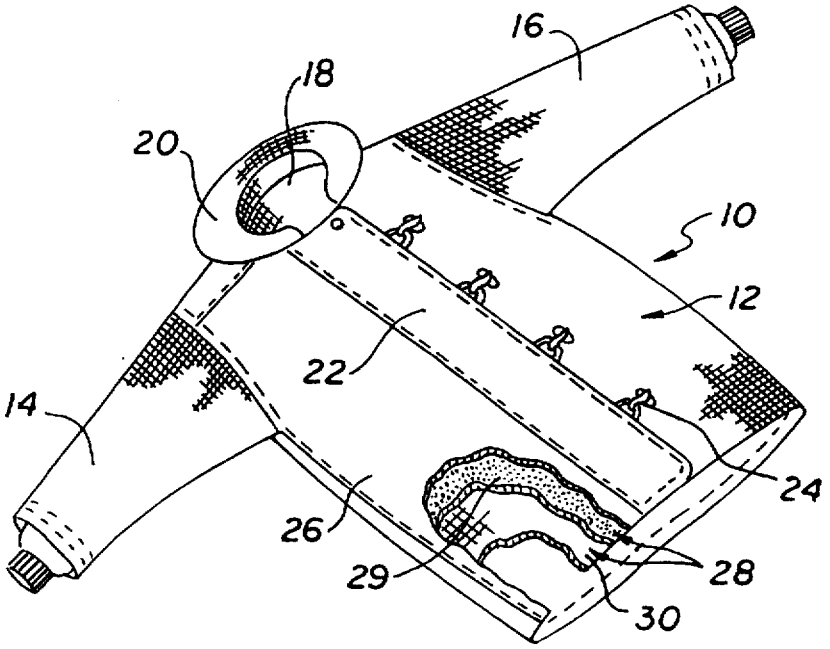
FIG. 1
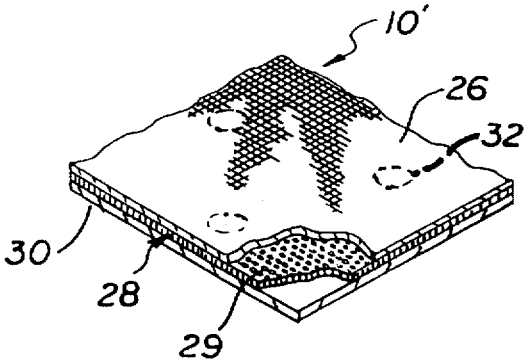
FIG. 3
FIG. 2A
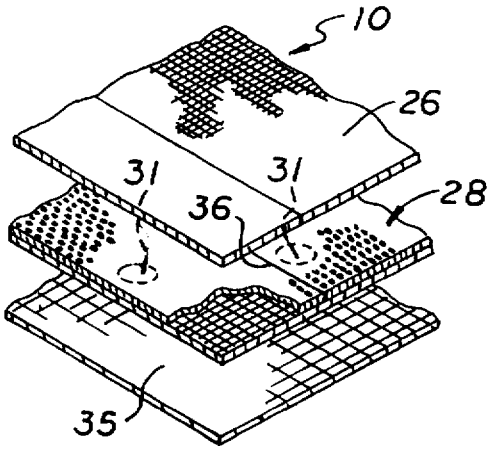

FIREFIGHTER GARMENT WITH CLOSED-CELL FOAM LINER

BACKGROUND OF THE INVENTION

The present invention relates to garments which protect the wearer from hazardous environmental conditions and, more particularly, to firefighter garments which provide heat and moisture resistance.

Firefighter garments are representative of garments designed to protect the wearer from a variety of environmental hazards. Typically, a firefighter garment includes an outer shell of an aramid fiber such as NOMEX or KEVLAR (both registered trademarks of E. I. DuPont de Nemours & Co., Inc.), or PBI (a registered trademark of Celanese Corporation), which provides resistance to abrasion and some thermal protection. Such garments also include a thermal barrier, which may comprise a layer of NOMEX and KEVLAR fibers, or a batting of such fibers, often quilted to a lightweight NOMEX face cloth. The batting of the thermal barrier traps air and possesses sufficient loft to provide the necessary thermal resistance, and the face cloth provides resistance to abrasion of the thermal liner by the wearer.

Moisture resistance may be provided by a layer of a poly/cotton fabric having a neoprene coating, positioned between the thermal liner and the outer shell. In the alternative, the thermal liner may comprise NOMEX fabric coated with fire-retardant neoprene, thereby functioning as a combined moisture barrier and thermal liner. Such garments typically do not breathe in the sense that perspiration moisture vapor generated by the wearer cannot escape from the garment through the thermal liner and moisture barrier.

The aforementioned ensemble possesses acceptable abrasion, thermal and moisture resistance properties, but there exist inherent disadvantages with such a garment. For example, a conventional thermal barrier possessing a sufficient TPP (thermal protection property) rating to meet N.F.P.A. (National Fire Protection Association) standards is somewhat bulky. This added volume increases the weight of the garment and produces a "hobbling" effect in that the freedom of movement of the wearer is restricted.

Further, since the batting of such prior art garments is somewhat uneven in thickness, it is necessary to provide a thermal liner which is nominally thicker than required to meet required TPP ratings, in order to ensure that the thermal liner meets such TPP ratings at all points on a garment, including at the thinner spots on the garment. Consequently, such constraints subject the wearer to stress and hasten the onset of fatigue in situations requiring high physical activity by the wearer.

Furthermore, the additional bulk of the garment resulting from the added thickness of the thermal liner requires additional shell material to cover it, thereby adding to the overall cost of the garment.

Accordingly, there is a need for a firefighter garment in which the loft or thickness of the thermal and moisture barriers is minimized in order that the overall weight of the garment is reduced, the amount of material required and hence the cost of the garment is minimized, and the freedom of movement afforded by the garment is enhanced.

SUMMARY OF THE INVENTION

The present invention is a firefighter garment having an outer shell, and a combined thermal liner and moisture barrier which consists of a layer of fire-retardant, closed-cell foam material. The closed-cell foam possesses the beneficial characteristics of moisture resistance and thermal insulation. Consequently, it is possible to provide a firefighter garment in which a separate, discrete moisture barrier and thermal liner is eliminated, so that the entire garment consists essentially of an outer shell, a layer of closed-cell foam material and, preferably, an inner liner of lightweight face cloth material to prevent abrasion of the foam layer by the clothing of the wearer.

In one embodiment of the invention, the closed-cell foam thermal liner/moisture barrier is bonded to a lightweight NOMEX face cloth and is placed loosely within the shell. The lamination of the face cloth to the foam layer would provide the foam layer with the necessary tear strength resistance to meet N.F.P.A. requirements. In another embodiment of the invention, the combined thermal liner/moisture barrier is bonded to the outer shell by a suitable adhesive and the seams are sealed, forming a unitary component of the garment. With such a design, the face cloth preferably is attached adhesively directly to the combined outer shell and liner to make an entirely unitary garment.

While such a construction could be used in many applications, such as high or low temperature environments, when used as part of a firefighter ensemble, other qualities must be present. For example, in the preferred embodiment, the foam liner is made of a fire-retardant material, such that when the foam liner is attached to a substrate of an aramid material, the combination resists melting, dripping, separating and igniting when exposed to temperatures of 500° F. for at least 5 minutes, a characteristic which enables the garment to meet N.F.P.A. requirements. Further, by bonding a foam liner including a substrate of aramid material directly to the outer shell, the combined thermal/moisture barrier meets the tear strength requirements of the N.F.P.A.

Consequently, the invention possesses many advantages over prior art garments. For example, the layer of closed-cell foam is lighter in weight and can be made thinner than prior art quilted battings of aramid fibers having comparable insulating properties. This reduction in thickness results not only from the superior insulating qualities of closed-cell foam, but the uniformity in thickness of the foam layer, which is superior to the uniformity in thickness of the prior art fiber insulation. This reduction in thickness reduces the amount of material required for the outer shell and therefore reduces the overall cost of the garment.

The reduction in thickness of the combined thermal liner and moisture barrier also minimizes the hobbling effect imposed by the garment on the wearer. This delays the onset of fatigue and reduces the stress on the wearer in high-activity situations.

Another advantage of the closed-cell foam liner over conventional fiber thermal liners is its resistance to absorption of water. This inherent property of the garment minimizes the weight gain of the garment when it becomes saturated with water, and facilitates drying of the garment. In addition, since the closed-cell foam does not become thoroughly soaked with moisture, it cannot create localized "hot spots" which occur when prior art fiber thermal liners become saturated with moisture in spots which absorb heat from the ambient and scald the wearer.

In another embodiment, a garment having a closed-cell foam liner, or any other approved liner system, is augmented with patches of closed-cell foam material positioned attached to the outer surface of the outer shell in strategic locations, such as the elbow, shoulder yoke or knee of the garment. Such pads or patches increase the thermal resistance in such areas in response to external pressure, as well as add resiliency to those areas in response to increased loading, as from the pads and straps of SCBA Equipment. Such pads can be retained on the external surface of the outer shell by patches of leather or aramid shell material.

Accordingly, it is an object of the present invention to provide a firefighter garment with a thermal liner consisting of closed-cell foam material which provides thermal resistance and moisture resistance; a firefighter garment in which the liner is relatively lightweight and resilient, yet possesses the necessary thermal protection property (TPP) ratings to meet N.F.P.A. standards; a firefighter garment having a closed-cell foam liner which is relatively easy to construct, launder and maintain; and a firefighter garment having a combined thermal liner and moisture barrier in which weight is reduced and freedom of movement is enhanced, resulting in reduced wearer stress and fatigue.

Other objects and advantages of the present invention will be apparent from the following description, the accompanying drawings and the appended claims.

BRIEF DESCRIPTION OF THE DRAWINGS

FIG. 1 is a somewhat schematic, perspective view of a firefighter garment incorporating a preferred embodiment of the present invention;

FIG. 2A is an exploded perspective view of the garment of FIG. 2, but showing taped seam;

FIG. 3 is an exploded, perspective detail similar to FIG. 2, but of an alternate embodiment of the invention;

DETAILED DESCRIPTION

Figure 2:
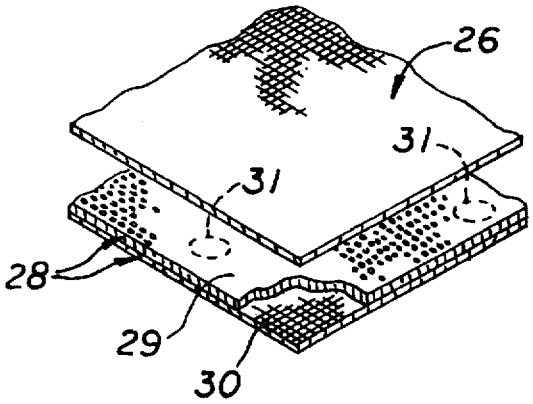
FIG. 2 is an exploded, perspective detail of the garment of FIG. 1 showing the layers of material comprising the ensemble.

As shown in FIG. 1, the present invention is embodied in a firefighter garment, generally designated 10, which is a firefighter coat having a body portion 12, sleeves 14, 16, a neck opening 18, a collar 20 surrounding the neck opening, and a front closure, generally designated 22. The front closure 22 is of conventional design and comprises snaps or a slide fastener (not shown) in combination with mechanical locking means such as hook and "D" combinations 24.

As shown in FIGS. 1 and 2, the garment 10 includes an outer shell, generally designated 26, of an aramid material such as NOMEX, which covers the entire garment. Extending throughout the garment 10 is an inner liner of a combined moisture barrier and thermal barrier 28, consisting of a layer of fire-retardant, closed-cell foam 29. The foam layer 29 is preferably about 3/32 inch thick, but should be at least 1/16 inch thick. A preferred fire-retardant material is ENSOLITE styles IV1, IV2, IV3, IV4, IV5, GIC, or IVC, all manufactured by Ensolite, Inc. of Mishawaka, Ind. A characteristic inherent in such fire-retardant materials is that when attached to a substrate of an aramid material, the combination resists melting, dripping, separating and igniting when exposed to temperatures of 500° F. for at least 5 minutes.

The foam layer 29 is adhesively bonded to a layer of lightweight face cloth 30, preferably made of NOMEX, by dots 31 of a suitable adhesive, such as the adhesive used to bond the membrane to the substrate of conventional moisture barriers. Consequently, the combined moisture barrier/thermal barrier 28 is comprised of the lamination of the foam layer 29 and face cloth 30. The barrier 28 is waterproof, and therefore prevents moisture from reaching the wearer, and possesses sufficient thermal insulation characteristics to protect the wearer from external heat sources. As shown in FIG. 2A, the combined moisture barrier/thermal barrier 28 of the garment 10 is sealed by suitable tape 35 at seams 36. Consequently, the liner 28 may be made up of patterns cut out to form the desired garment 10.

In another embodiment, shown in FIG. 3, the combination moisture barrier/thermal barrier 28 is bonded to the inner surface of the outer shell 26 by dots 32 of a suitable adhesive. Seams are sealed conventionally, as by strips of tape (not shown), preferably about ¾ inches wide. Consequently, the garment 10' is unitary in construction in that the outer shell 26 and barrier 28 are one piece. With either embodiment, the ensemble allows more freedom of movement and is lighter in weight than prior art garments.

The method of manufacture of the garment 10 is somewhat conventional in nature. With the embodiment of FIG. 2, the outer shell is constructed along conventional lines, in which patterns are cut from a roll of shell material and stitched together. The combined thermal liner and moisture barrier is first made in roll form as a laminate of closed-cell foam material and a fabric face cloth substrate, then cut in patterns which are stitched together to form the liner. The seams of the combined thermal liner and moisture barrier are sealed with tape 35 (see FIG. 2A) in a conventional manner. The combined thermal liner and moisture barrier is then inserted within the outer shell, and is attached by snaps, strips of hook and loop material or by stitching. Accordingly, the combined thermal liner and moisture barrier is removable from the outer shell.

Figure 4:
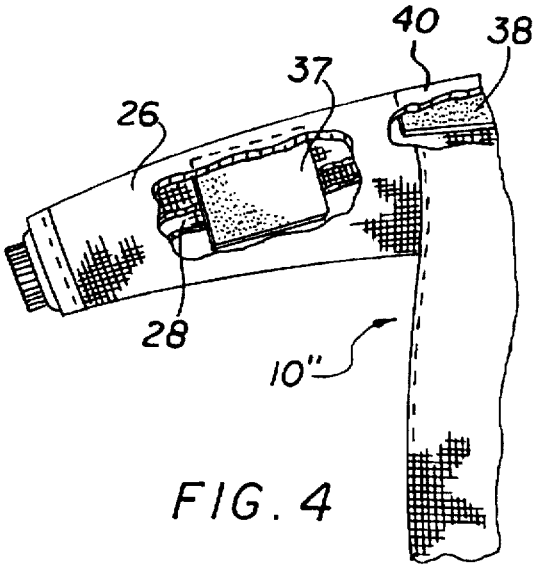
FIG. 4 is a detail of the garment of FIG. 1, but modified to include additional padding in strategic areas internally of the outer shell.

As shown in FIG. 4, pads 37, 38 are positioned on a garment 10" in strategic locations, such as the elbow for pad 37 and the shoulder yoke area for pad 38. Pad 37 is positioned between the outer shell 26 and the liner 28 of the garment. In the preferred embodiment, the pad 37 would be held in position by stitching to the outer shell, or by strips of hook and loop material (not shown) between the pad and the outer shell. Pad 38 is similar to pad 37 in that it is made of closed-cell foam material, but it also includes apertures to reduce weight.

Figure 5:
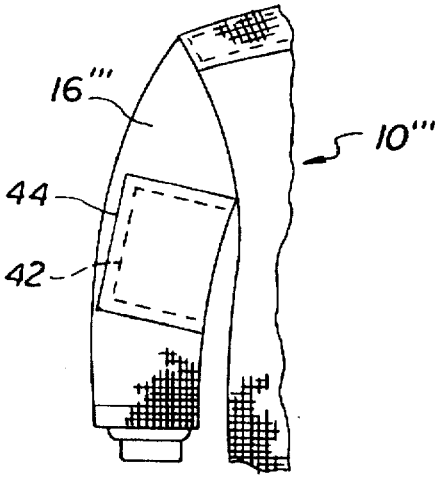
FIG. 5 is a detail of the garment of FIG. 1, but modified to include additional padding in strategic areas externally of the outer shell.

As shown in FIG. 5, a pad of closed-cell foam material 42 is mounted on the elbow portion of a sleeve 16'" of a garment 10'" and retained in position by a covering patch 44 of leather or an aramid material, such as NOMEX, which is stitched to the outer shell. Such a patch 42, similar to patches 37 and 38, would provide increased thermal protection in these areas, as well as distribution of loads applied externally to these areas.

Figure 6:
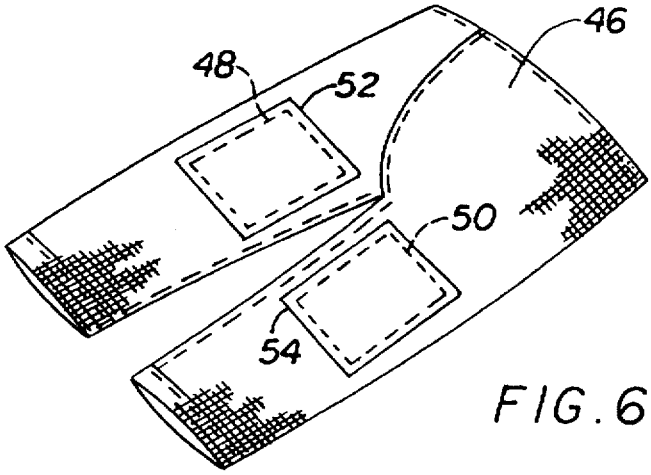
FIG. 6 is a schematic, perspective view of a firefighter pant having reinforcing pads according to the present invention.

As shown in FIG. 6, similar construction can be applied to a pant 46, which would have the same ensemble construction as either of FIGS. 2 or 3. Furthermore, the knee portions of the pant 46 preferably would include pads 48, 50 of closed-cell foam material covered by leather patches 52, 54. Such pads 48, 50 could be either of the apertured or non-apertured variety. Again, such padding would provide increased thermal and compression resistance in the knee area.

While the forms of apparatus herein described constitute preferred embodiments of this invention, it is to be understood that the invention is not limited to these precise forms of apparatus, and that changes may be made therein without departing from the scope of the invention.

What is claimed is:

1. A method of manufacturing a firefighter garment comprising the steps of:

providing an outer shell of flame retardant and abrasion resistant material;

providing an inner liner of a closed-cell foam material attached to a substrate, a combination of said substrate and said foam material being sufficiently fire retardant such that said combination resists melting, dripping, separating and igniting when exposed to temperatures of 500° F. for at least 5 minutes for use in a firefighter garment; and inserting said inner liner within said outer shell.

2. The method of claim 1 further comprising the step of bonding said fire retardant, closed-cell foam material to a fire retardant, abrasion resistant substrate.

3. The method of claim 2 wherein said bonding step includes the step of bonding a layer of face cloth material to said foam material.

4. The method of claim 1 further comprising the step of bonding said layer of foam material to said outer shell.

5. The method of claim 4 further comprising the step of bonding a layer of fabric material to an inner surface of said foam material, whereby said foam material is protected from abrasion from clothing of a wearer of said garment.

6. The method of claim 5 wherein said fabric material comprises face cloth material.

7. The method of claim 1 wherein said foam material is between about 1/16 inches (1.59 mm) and 3/32 inches (2.38 mm) thick.

8. A firefighter garment comprising:

an outer shell;

a liner made of a continuous, closed-cell foam material sufficiently fire retardant for use in a firefighter garment and a substrate, said foam material being bonded to said substrate such that said substrate provides resistance to tearing and abrasion of said foam material, whereby said liner provides a moisture-resistant thermal protection layer and resists melting, dripping, separating and igniting when exposed to temperatures of 500° F. for at least 5 minutes; and said liner being detached and removable from said outer shell.

9. A firefighter garment comprising:

an outer shell;

a liner made of a closed-cell foam material sufficiently fire retardant for use in a firefighter garment and a substrate, said foam material being bonded to said substrate such that said substrate provides resistance to tearing and abrasion of said foam material, whereby said liner provides a moisture-resistant thermal protection layer and resists melting, dripping, separating and igniting when exposed to temperatures of 500° F. for at least 5 minutes; and wherein said liner extends only in selected portions of less than said entire garment, said liner providing increased resistance to wear and compression.

10. The garment of claim 9 wherein said liner consists of a plurality of pads of closed-cell foam liner.

11. For use with a firefighter garment having an outer shell made of an abrasion-resistant, fire-retardant material suitable for use in a firefighter garment, a combination moisture barrier and thermal liner comprising:

a liner shaped to fit within said outer shell and made of a continuous, fire-retardant, closed-cell foam material sufficiently fire retardant for use in a firefighter garment and a substrate, whereby said liner provides a moisture-resistant thermal protection layer and resists melting, dripping, separating and igniting when exposed to temperatures of 500° F. for at least 5 minutes.

12. The liner of claim 11 further comprising a substrate bonded to said closed-cell foam material, said substrate providing resistance to tearing and abrasion of said foam material.

13. A firefighter garment comprising:

an outer shell made of an abrasion-resistant, flame and heat resistant material suitable for use in a firefighter garment; and a liner made of a continuous, closed-cell foam material sufficiently fire retardant for use in a firefighter garment and a substrate, said foam material being bonded to said substrate such that said substrate provides resistance to tearing and abrasion of said foam material;

whereby said liner provides a combined moisture-resistant and thermal protection layer for said wearer and resists melting, dripping, separating and igniting when exposed to temperatures of 500° F. for at least 5 minutes.

14. The garment of claim 2 wherein said substrate includes a layer of face cloth material positioned between said liner and a wearer of said garment, whereby said face cloth prevents abrasion of an inner surface of said garment by clothing of a wearer of said garment.

15. The garment of claim 14 wherein said layer of face cloth material is bonded to said liner.

16. The garment of claim 13 wherein said layer of closed-cell foam is between about 1/16 inches (1.59 mm) and 3/32 inches (2.38 mm) thick.

17. A firefighter garment comprising:

an outer shell made of an abrasion-resistant, flame and heat resistant material selected from the group consisting of aramid fibers and polybenzimidazole fibers suitable for use in a firefighter garment; and a liner made of a continuous, fire retardant, closed-cell foam material sufficiently fire retardant for use in a firefighter garment and a substrate, said foam material being bonded to said substrate such that said substrate provides resistance to tearing and abrasion of said foam material;

whereby said liner provides a combined moisture-resistant and thermal protection layer for said wearer and resists melting, dripping, separating and igniting when exposed to temperatures of 500° F. for at least 5 minutes.

* * * * *